United States Patent [19]

Epes

[11] Patent Number: 4,509,304

[45] Date of Patent: Apr. 9, 1985

[54] METHOD AND APPARATUS FOR INSERTING INSULATION IN PREEXISTING BUILDING STRUCTURES

[76] Inventor: Jack R. Epes, 520 North First St., Lompoc, Calif. 93436

[21] Appl. No.: 495,947

[22] Filed: May 19, 1983

[51] Int. Cl.[3] ..... E04F 21/06

[52] U.S. Cl. ..... 52/127.3; 52/406; 52/743; 52/749; 52/DIG. 1

[58] Field of Search ..... 52/741, 743, 127.3, 52/127.4, 127.5, 127.7, 127.9, 404, 406, 407, DIG. 1, 749

[56] References Cited

U.S. PATENT DOCUMENTS

| | | | |
|---|---|---|---|
| 1,998,425 | 4/1935 | McNeil | 52/406 X |
| 2,226,617 | 12/1940 | Kuenzli | 52/743 |
| 2,551,751 | 5/1951 | MacDougall | 52/743 |
| 2,821,896 | 2/1958 | Kice et al. | 52/743 X |
| 2,906,655 | 9/1959 | Blumenstein | 52/406 |
| 3,003,902 | 10/1961 | McDuff | 52/406 |
| 3,124,853 | 3/1964 | Glaser et al. | 52/743 |
| 3,231,944 | 2/1966 | Bennett | 52/406 |
| 3,307,318 | 3/1967 | Bauman | 52/743 |
| 3,364,639 | 1/1968 | Davenport | 52/407 X |
| 4,177,618 | 12/1979 | Felter | 52/743 |
| 4,182,085 | 1/1980 | Elson | 52/2 |
| 4,399,645 | 8/1983 | Murphy et al. | 52/743 |

*Primary Examiner*—J. Karl Bell

*Attorney, Agent, or Firm*—Schwartz, Jeffery, Schwaab, Mack, Blumenthal & Koch

[57] ABSTRACT

The device for installing batts of insulation in preexisting structures comprises a control sheet having a substantially flat elongated surface for receiving a batt of insulation, a first end having a handle, and a second end which is free for insertion into a wall opening, and a compressor sheet having a substantially flat enlongated surface for overlying the control sheet flat surface to compress a batt of insulation therebetween, a first end having a handle, and having a second end which is free for insertion into a wall opening. A latch is provided for connecting the control sheet second end to the compression sheet second end such that the sheets are maintained a predetermined distance apart to compress a batt of insulation and the compressor sheet second end and the control sheet second end overlie one another. The latch includes a release for releasing a batt of insulation after insertion into a wall opening.

15 Claims, 16 Drawing Figures

METHOD AND APPARATUS FOR INSERTING INSULATION IN PREEXISTING BUILDING STRUCTURES

BACKGROUND OF THE INVENTION

1. Field of the Invention

This invention relates to devices and methods for providing insulation to building structures and more particularly to devices and methods by which preexisting building structures can be insulated without the need for a substantial reconstruction of the structure.

2. Discussion of Related Art

In recent times, the price of fossil fuel has increased dramatically. This has resulted in a severe increase in the cost of providing heat to offices, homes and other structures during the cold months of the year. In many instances, new construction takes this increased cost into account by adding insulation where necessary to reduce the heat loss in the building. However, many structures were built long before the present "energy crisis" and were provided with little or no insulation in the ceiling and walls.

In some cases, this defect can be overcome. For example, in buildings where the ceilings are exposed in an attic, batts of insulation can be added to increase the thermal efficiency of the building. However, in walls the problem is more severe. In order to install batts of fiberglass insulation, the interior wall covering must be substantially entirely removed in most instances. Therefore, the conventional method of insulating walls is to use blown cellulose insulation which is inserted in an opening formed above the area to be insulated. However, as is well known, such blown insulation has several drawbacks. For example, this type of insulation is more prone to absorb moisture than fiberglass bats. Moisture absorbed in insulation severely reduces the R value of the insulation and in some cases renders the insulation almost valueless. Also, blown insulation has a tendency to compact over time, especially when installed in walls where long vertical columns of the insulation are necessarily used. The compaction causes the upper portion of the wall to be rendered uninsulated while the R value of the insulation in the compacted lower wall portion is reduced.

Accordingly, it would be desirable to have a device and method by which batts of fiberglass insulation could be installed in the walls of preexisting building structures without having to disassemble or substantially reconstruct the building.

Various systems and devices are known for providing insulation for buildings or compressing materials for insertion into defined spaces.

U.S. Pat. No. 1,334,745 discloses a device for filling cushion pipings which comprises two elongated members which are releasably attachable at one end to compress a spongy material for insertion into the cushion piping.

U.S. Pat. No. 1,592,838 to Ries describes an apparatus for compressing springs, which apparatus has two flat plate-like members which are attachable at both a handle end and at the end opposite from the handle.

U.S. Pat. No. 2,207,930 to Miller describes a device for applying tax stamps to packaged goods. The device includes a pair of flat members which can be used to manipulate the stamp.

U.S. Pat. No. 4,204,373 to Davidson shows a method for inserting thermal insulation into cavities of a building. The method comprises the steps of compressing a compressible insulation material and holding the compressed material within an envelope which can be unsealed by means of a rip cord to cause the insulation to expand to a free state after insertion into a building cavity.

U.S. Pat. No. 4,182,085 to Elson shows a method and structure for insulating a wall or ceiling wherein a compressible insulation material is disposed within an inflatable envelope. The envelope is inserted in the space to be insulated and then inflated.

U.S. Pat. No. 3,327,449 to Hullhorst et al and U.S. Pat. No. 3,124,853 to Glaser show the compression of insulaton to a reduced volume followed by sealling of the compressed insulation within a vacuum or container.

U.S. Pat. No. 3,307,318 to Bauman and U.S. Pat. No. 2,226,617 to Kuenzli show the disposition of insulation within an envelope or containing structure to facilitate mounting the insulation within a cavity.

U.S. Pat. No. 2,551,751 to MacDougall, Jr. shows inserting a flaccid yet expandible element into a building cavity.

U.S. Pat. No. 860,334 to French et al describes a press mat having teeth-like projections which hold a compressible mat to one of the face plates of the press structure.

SUMMARY OF THE INVENTION

One object of the present invention is to provide a device which can be used to insert batts of insulation through a relatively small opening formed in an area to be insulated.

Another object of the present invention is to provide a device for inserting insulation into areas of a structure to be insulated which device can be manipulated relatively easily to ensure that the insulation is adequately positioned in the space to provide maximum thermal efficiency.

Yet another object of the present invention is to provide a device which can be used to insert conventionally available batts of fiberglass insulation into openings in a building structure.

Another object of the present invention is to provide a device for inserting insulation into a building structure, which device is relatively easy to manufacture, is highly effective in use, and is relatively durable and reusable so as to be capable of use over a prolonged period of time.

Another object of the present invention is to provide a device for inserting insulation into openings in a building structure, which device is designed so as to be easily withdrawn from the opening without adversely shifting the insulation once it is properly positioned.

Another object of the present invention is to provide a method for insulating preexisting building structures by inserting batts of insulation into openings therein.

A further object of the present invention is to provide a method for insulating preexisting building structures whereby batts of insulation can be maneuvered into position in a compressed state and allowed to expand to fill the space to be insulated.

In accordance with the above and other objects, the present invention includes a device for installing batts of insulation in preexisting building structures. The device comprises a control sheet having a substantially flat elongated surface for receiving a bat of insulation, a first end having a handle, and a second end having a bent portion for insertion into an opening in a wall or ceiling of the building. The device also includes a compression sheet having a substantially flat elongated surface for overlying the control sheet flat surface to compress a bat of insulation therebetween, a first end having a handle, and a second end with a bent portion for insertion into a wall opening. A means for connecting the control sheet second end to the compression sheet second end is provided for attaching the sheets together such that a batt of insulation is compressed therebetween and the curved portions of the sheets overlie one another. The device also includes a means for releasing the connecting means so that the batt of insulation can be allowed to expand after inserton into a space to be insulated.

In accordance with other aspects of the invention, the bent portion of the control sheet has a recurved portion which forms a slot to receive a free end of the compression sheet bent portion.

Also, the connecting means is positioned at the second ends of the sheets and the release means is positioned at the first ends of the sheets. Further, a remote actuator is connected between the release means and the connecting means. The remote actuator may comprise a cable and the connecting means may comprise an eyelet connected to one of the sheets, an opening formed in the other of the sheets for receiving the eyelet, and a latching member connected to the cable and positioned for insertion into the eyelet. The release means comprises a control member connected to the cable for moving the cable whereby movement of the control member causes the latching member to move into or out of the eyelet.

In accordance with other aspects, one of the sheets is provided with gripping means for gripping a bat of insulation. The gripping means may be in the form of a plurality of teeth attached to the compression sheet flat elongated surface. The teeth may be angled toward the second end of the compression sheet whereby the teeth grip a bat of insulation only when the compression sheet is moved in the direction of the compression sheet second end but release the batt of insulation when moved in the opposite direction.

The device may also include means for attaching the control sheet first end to the compression sheet first end. The attaching means may in the form of a pair of offset flanges attached to one of the sheets to define slots for receiving edge portions of the other sheet.

The invention further comprises a method of installing batts of insulation in a preexisting building structure. The method comprises compressing a batt of insulation between two relatively flat sheets of flexible material by attaching the sheets together on opposite sides of the insulation. The batts and sheets are inserted into an opening formed in a wall, ceiling or the like at one end of the position in which the insulation is to be placed such that one end of each sheet extends out of said opening and another end of each sheet extends into the opening. The sheets are released from each other when the insulation is approximately in position and the sheets are then withdrawn from the opening to leave the insulation in place.

During the step of compressing, the ends of the sheets which are to be inserted in the opening are attached together and during the step of releasing the sheets, the sheets are detached by actuating a release mechanism from a position externally of the opening.

When the sheets are withdrawn from the opening, one sheet is first pulled by a slight amount from the opening. The other sheet is then pulled by a similar amount after which both sheets are pushed back in the opening to move the insulation into the desired position. Then both sheets are withdrawn completely one at a time. One of the sheets may have teeth formed thereon. This sheet is pulled first both by a small amount and during the complete withdrawal process.

Each of the sheets has a bent end which overlie one another when a batt of insulation is compressed therebetween. The bent ends are inserted into the wall first to serve as a guide for moving the insulation into position.

BRIEF DESCRIPTION OF THE DRAWINGS

The above and other objects will become more readily apparent when the invention is more fully described in the detailed description to follow, reference being had to the accompanying drawings in which like reference numerals represent like parts throughout and wherein.

DETAILED DESCRIPTION OF THE PREFERRED EMBODIMENT

Figure 1:
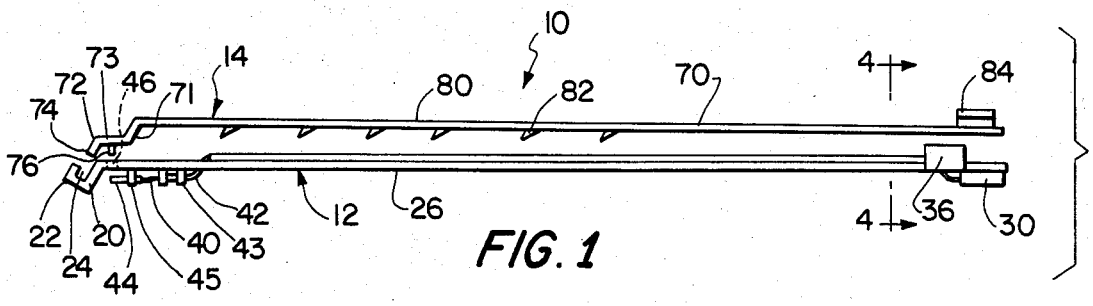
FIG. 1 is a side elevational exploded view showing the control and compression sheets of the present invention.

FIG. 1 shows the insulation inserting device 10 of the present invention. The device 10 comprises a control sheet 12 and a compressor sheet 14 which are shown separated for clarity although they are connected in a manner to be discussed hereinafter when in use.

Figure 2:
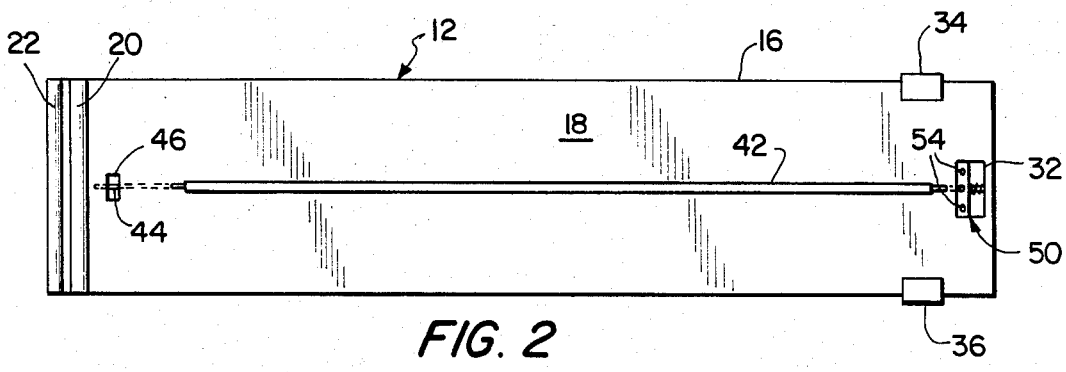
FIG. 2 is a top plan view of the control sheet of the present invention.

Control sheet 12 is shown in FIGS. 1 and 2 to comprise an elongated flexible body 16 which can be formed of sheet metal, synthetic resin material, or any other suitable material. Body 16 has a substantially flat surface area 18 against which a bat of insulation to be compressed is received. Flat surface area 18 extends to a downwardly curved portion 20 which terminates in a recurved portion 22. Recurved portion 22 defines a slot 74 which is substantially parallel to the downwardly curved portion 20 and receives a free end of compression sheet 14. The outer surface 26 of control sheet 12 is relatively smooth so as to enable it to slide into relatively tight spaces without being caught on obstructions such as nails, wood splinters or the like.

The overall length of control sheet 26 can be varied to suit the installation in which it is to be used. However, in practice, a length of approximately 55 inches at a minimum has been found to be desirable. The downwardly curved portion 20 is approximately 1½ inches in length although this portion is shown exaggerated in the figures for clarity. The recurved portion 22 extends back about ½ inch such that groove 24 is ½ inch deep. Curved portion 20 makes an angle of about 15° with the body 16 so that when resting on a horizontal surface, the junction between body 16 and curved portion 20 rests slightly above the horizontal. In this regard, it is noted that while curved portion 20 has been described as being downwardly curved, this term is used in reference to FIG. 1 only, inasmuch as the orientation of control sheet 26 will be varied to enable it to slide into openings in walls, ceilings or any other opening leading to a space to be insulated.

Figure 4:
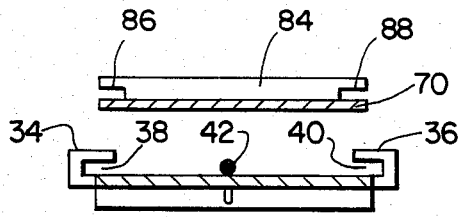
FIG. 4 is an elevational sectional view taken substantially along a plane passing through section lines 4—4 of FIG. 1.

At the end of control sheet 12 opposite to recurved portion 22, a handle is formed by attaching a substantially rectangular element 30 to the free end of body 16. Rectangular element 30 can be made of wood, synthetic resin or any other suitable material and is attached to body 18 by use of glue, screws or the like. An opening 32 is formed through body 16 and element 30 so as to form a hand hold. Accordingly, control sheet 12 can be grasped by opening 32 and manipulated. Additionally, a pair of offset flanges 34 and 36, which can be seen more clearly in FIG. 4, are attached to opposite sides of body 16. Flanges 34 and 36 form opposing grooves 38 and 40 which receive opposite edges of compression sheet 14 as will be discussed hereinafter. Flanges 34 and 36 serve to retain and guide the compression sheet when it is moved on the control sheet.

Figure 5:
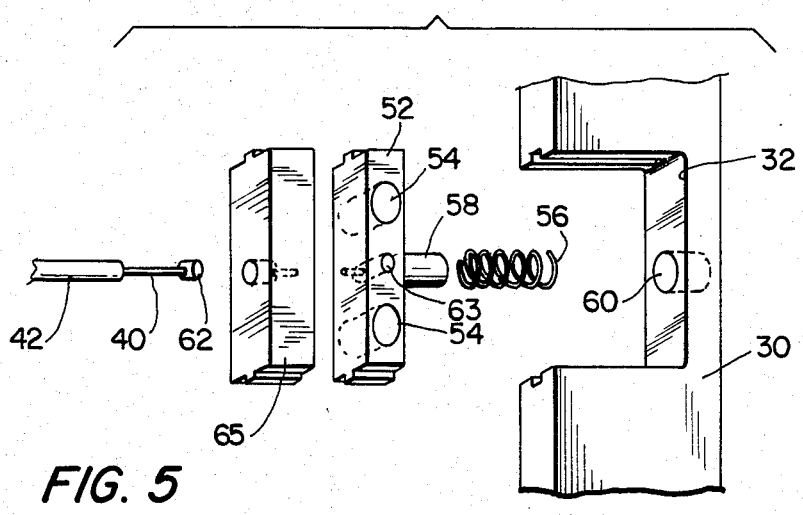
FIG. 5 is an exploded, perspective view of the latch actuation mechanism of the present invention.

Control sheet 12 also mounts a latching mechanism which comprises a cable 40 and a cable sheathing 42 which is attached to surface 18. Cable 40 and sheathing 42 extend through an opening formed in sheet 12 and sheathing 42 is held against surface 26 by retainers 43. Cable 40 terminates in an elongated pin 44 which is positioned below a slot 46 formed on the flat surface 18. Pin 44 is held in guide 45 so that it can move back and forth. As seen in FIGS. 1 and 2, by pulling on cable 40, pin 44 can be moved toward or away from the area just below slot 46. In order to actuate cable 40, a manual slide mechanism 50 shown most clearly in FIGS. 2 and 5 is provided. Slide mechanism 50 is mounted within opening 32 and comprises a slide member 52 movably mounted in opening 32. Slide member 52 includes finger holes 54 which can be used to move slide member 52 against the action of a spring 56. Spring 56 is mounted on a guide rod 58 which is received in a guide opening 60 formed in member 30. Slide member 52 receives the terminal end of cable 40 which is affixed thereto. As shown in FIG. 5, the terminal end of cable 40 has an enlarged bulge 62 which is received in a mating opening 63 in slide member 52. Opening 32 is closed off by a cable housing retainer and flex compensation guide 65 through which cable 40 passes and against which sheathing 42 abuts. Cable 40 and sheathing 42 extend through a hole formed in sheet 12 and are connected to the flat surface 18.

In operation, when the user pulls on slide member 52, cable 40 is pulled through sheathing 42 and pin 44 moves away from slot 46. When slide member 52 is released, spring 56 forces cable 40 back to its original position and pin 44 moves past opening 46.

Figure 3:
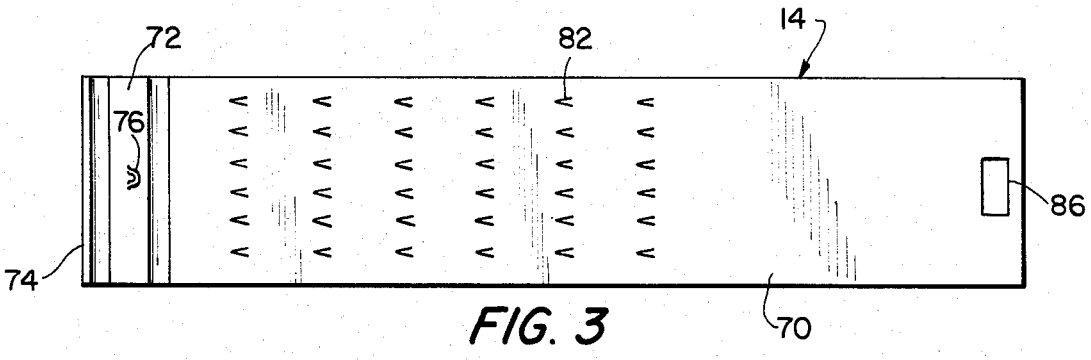
FIG. 3 is a bottom plan view of the compression sheet of the present invention.

Compression sheet 14 is shown most clearly in FIGS. 1, 3 and 4 and comprises a body 70 which is connected at one end to a bent portion 71. Bent portion 71 is in turn connected to a flat piece 73 which is substantially parallel to body 70. Flat piece 73 terminates in another bent portion 72 which has a free end 74 which can slide within groove 24 formed in recurved portion 22 of control sheet 12. Bent portions 71 and 72 are formed at a similar angle of approximately 15° to the plane of surface 18. Bent portion 71 is about 1½ to 2 inches long while bent portion 72 is between 1 and 1½ inches in length.

To complete the latching mechanism for sheets 12 and 14, an eyelet 76 is attached to flat piece 73 and is positioned to fit within opening 46 in the sheet 12. Eyelet 76 can extend through opening 46 by a sufficient amount to receive pin 44 which serves to latch the two sheets together. In this regard, for ease of operation, opening 46 should be at least ½ inch greater in length than the thickness of eyelet 76 so that eyelet 76 can be receiving in opening 46 and sheet 12 can then be moved forward so that free edge 74 is received in slot 24. As will be apparent hereinafter, the latch mechanism comprising eyelets 76 and pin 44 serve to compress a batt of insulation received between sheets 12 and 14 while recurved portion 22 serves to protect free edge 74 from snagging on obstacles encountered in the space to be insulated.

The outer surface 80 of sheet 14 is smooth so as not to catch on any obstructions in the space to be insulated. Accordingly, when sheets 12 and 14 are connected, outer surfaces 26 and 80 present a smooth sliding surface to facilitate insertion of the device 10 in an opening.

The flat surface 70 of sheet 14 includes a plurality of teeth 82 which are inclined forwardly or toward the bent portion 72 of the sheet. Teeth 82 are disposed in rows with any number of teeth desired per row and a sufficient number of rows to ensure that the teeth will adequately bite into a bat of insulation. The teeth 82 are angled forwardly so that forward movement of sheet 14 will cause a bat of insulation to move with it while, when sheet 14 is moved to the rear, teeth 82 will disengage the insulation and slide therepast.

At the end of sheet 14 opposite to bent portions 72 and 72 a handle 84 is connected. Handle 84 may be a piece of wood, synthetic resin material or the like which is glued or otherwise attached to the outer surface 80 of sheet 14. An opening 86 is formed through the body 70 and handle 84. Opening 86 is positioned so as to align with opening 32 when sheets 12 and 14 are latched together. Also, as shown in FIG. 4, handle 84 is formed with a pair of recesses 86 and 88 on opposite sides thereof. Recesses 86 and 88 are designed to permit offset flanges 34 and 36 to slide past handle 84 when the lateral edges of body 70 are received in slots 38 and 46.

Figure 6:
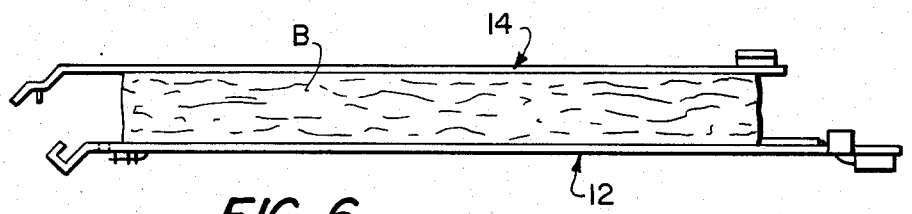
FIG. 6 is a schematic representation showing the control and compression sheets with a bat of insulation before compression.
Figure 7:
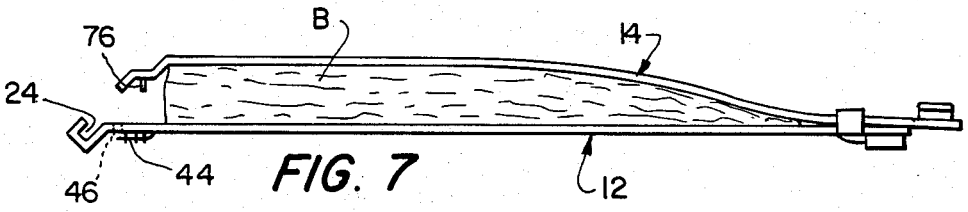
FIG. 7 is a schematic view showing the engagement of one end of the control and compression sheets.
Figure 8:
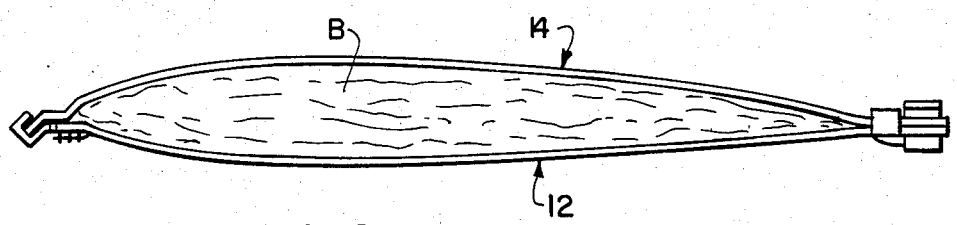
FIG. 8 is a schematic view showing the insulation completely compressed with both ends of the sheets engaged.
Figure 9:
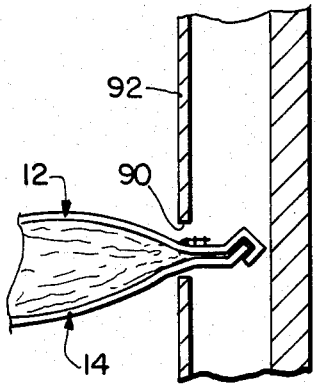
FIG. 9 is a schematic view showing the compressed insulation, control and compression sheets being inserted in an opening in a wall from below.

In operation, a batt of insulation B is placed upon the flat surface 18 of control sheet 12 as shown in FIG. 6. Compressor sheet 14 is then laid upon the insulation and the rear of the compressor sheet is pressed downwardly. The rear edge of compressor sheet 14 is then inserted in slots 38 and 40 as shown in FIG. 7 and the compressor sheet is moved rearwardly with slots 38 and 40 guiding compressor sheet 14. Compressor sheet 14 is moved to the rear until eyelet 76 is over the rearwardmost part of slot 46. Actuator element 52 is then drawn rearwardly to pull pin 44 away from slot 46 and the front part of sheet 14 is pushed downwardly and forwardly to compress the forward portion of batt B and to move the front edge of sheet 14 into groove 24. Actuator element 52 is then released to permit pin 44 to slide through eyelet 76 and latch the front of sheets 12 and 14 together. Accordingly, batt B is held in its compressed state with the forward ends of sheets 12 and 14 held by pin 44 and eyelet 76 and the rear ends of the sheets held by flanges 34 and 36. Openings 86 and 32 are now aligned and the entire configuration can be picked up easily by using these openings as a handle, grasping the handle with one hand, and supporting sheets 12 and 14 from below with the other hand.

It should be noted that when batt B is laid on control sheet 12, if insulation with a vapor barrier is being used, the vapor barrier should be laid directly on the exposed surface of sheet 12 with the exposed insulation of the batt engaging teeth 82 of compression sheet 14.

The method of using device 10 will now be described for installing a batt of fiberglass insulation through an interior building wall 92. It will, of course, be understood that device 10 could also be used in a similar manner to install insulation in a ceiling, floor, etc. or in other structures such as vans, trucks or the like.

Figure 10:
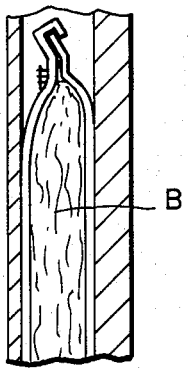
FIG. 10 is a schematic view showing the sheets and insulation inserted into the space to be insulated.
Figure 11:
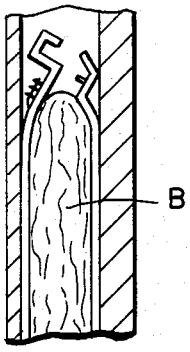
FIG. 11 is a schematic view showing the separation of the sheets.
Figure 12:
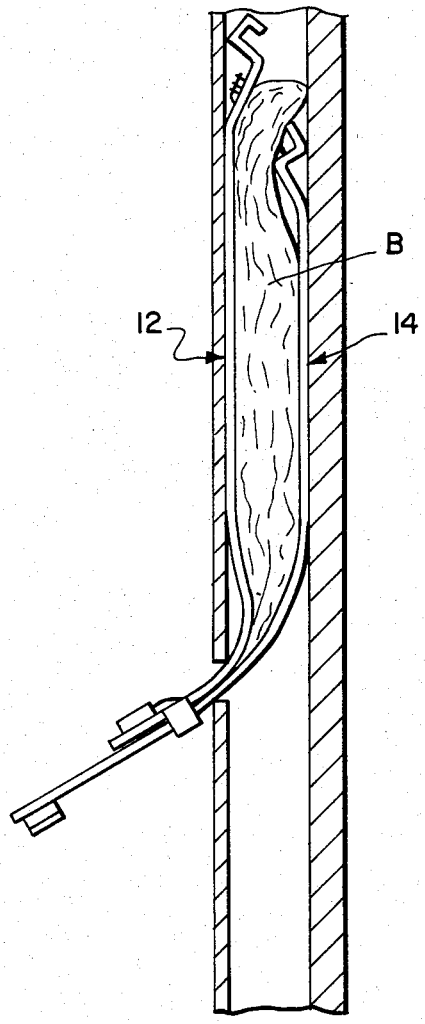
FIG. 12 is a schematic view showing one of the sheets partially withdrawn.
Figure 13:
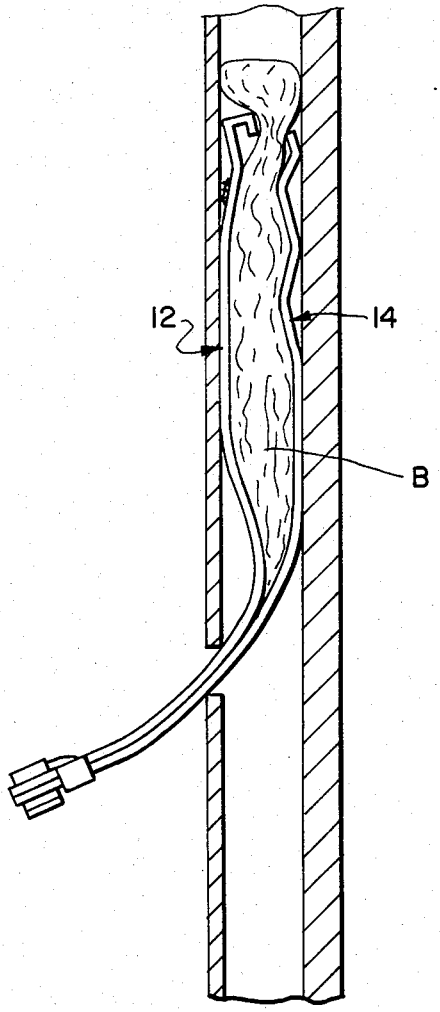
FIG. 13 is a schematic view showing both of the sheets withdrawn partially.
Figure 14:
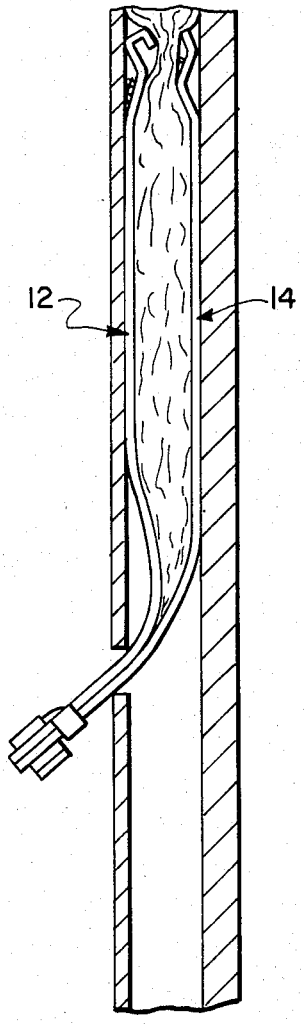
FIG. 14 is a schematic view showing the sheets manipulated to fully insert the insulation within the space to be insulated.
Figure 15:
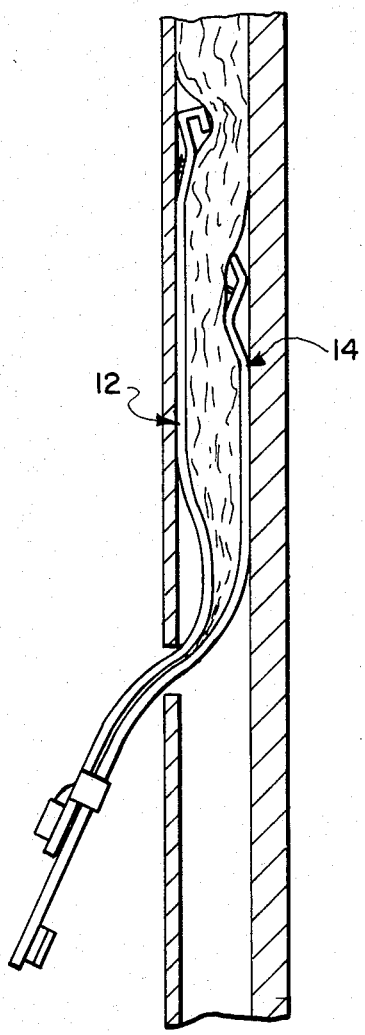
FIG. 15 is a schematic view showing additional withdrawal of one of the sheets.
Figure 16:
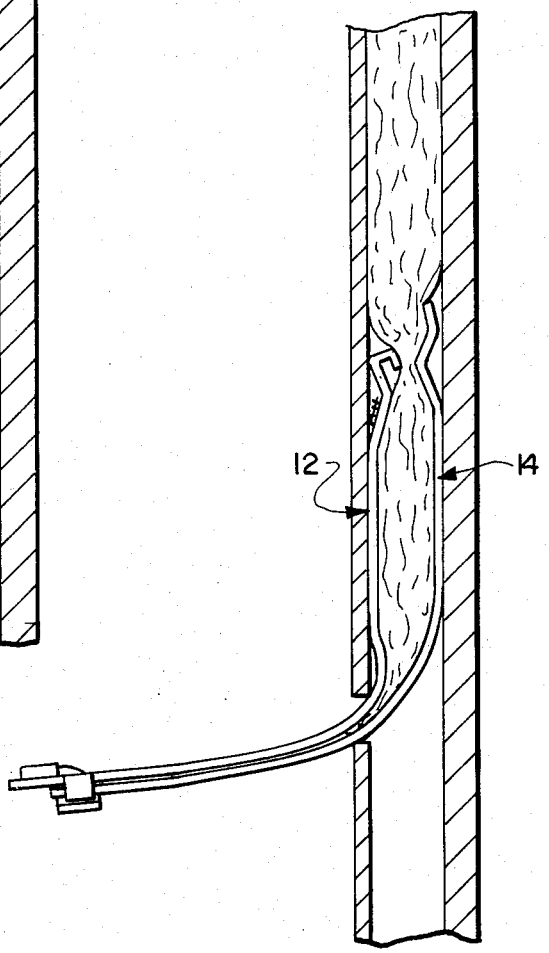
FIG. 16 is a schematic view showing additional withdrawal of both sheets.

When installing insulation upward, as shown in FIGS. 9–16, a slit 90 is formed in the lower portion of wall 92 below the area in which the insulation is to be disposed. The slit should be approximately 2½ inches wide and have a length sufficient to accept the full width of sheets 12 and 14. To insert device 10 into slit 90, the device is turned over so that control sheet 12 is on top and compressor sheet 14 is on the bottom such that the bent portions of the sheets 12 and 14 face toward the space to be filled with insulation. The bent portions are maneuvered into the space and moved upward. Sheets 12 and 14 are formed from flexible material so that they can be bent to a considerable degree during this maneuvering process. As shown in FIG. 10, device 10 is moved into the cavity behind wall 92 until the front of the device engages the upper end of the cavity. Of course, although not shown in FIG. 10, at this time the handles of device 10 will protrude from opening 90. As shown in FIG. 11, actuator 52 is pulled to release sheets 12 and 14 and compressor sheet 14 is then pulled back slightly so as to be moved free of groove 24. At this time insulation batt B is allowed to expand forcing the sheets apart. Sheet 14 is then pulled back by a distance of about 3 inches so that the free edge of sheet 14 engages bat B as shown in FIG. 12. Sheet 12 is then also pulled back by a similar distance. At this point, sheets 12 and 14 are moved down slightly from the forward end of batt B as shown in FIG. 13. Sheets 12 and 14 are the pushed forward until batt B is pushed all the way up into the cavity behind wall 92 as shown in FIG. 14. Sheets 12 and 14 are then withdrawn completely from opening 90 by moving the sheets downwardly one at a time starting with sheet 14, as shown in FIGS. 15 and 16. As sheets 12 and 14 are withdrawn, batt B is allowed to fully expand within the space behind wall 92 as shown in FIG. 16.

As can be seen, by forming a separate opening 90 in each interior wall 92 of a building between adjacent joists, a bat of insulation can be inserted into the space behind the wall with a vapor barrier directly adjacent the wall.

If desired, the insulation can be inserted from an opening formed at the upper end of the space to be insulated by simply turning the device 10 over so that the control sheet 12 is on the bottom and the angled portions of sheets 12 and 14 face the space to be insulated. The process is then carried forward in a manner similar to that described above as would be obvious to one of ordinary skill in the art.

Whether inserting the insulation from above or below the space to be insulated, it is important to note that the compressor sheet 14 must always be the first to be pulled to ensure a complete release from batt B. The control sheet is only pulled after the compressor sheet has been initially moved.

When using device 10 of the present invention, all nails driven into the inner walls that protrude into the wall cavity to be insulated should be removed. Wires or pipes running parallel to the forward motion of device 10 can be avoided by using a slightly smaller width device 10. If wires or pipes run at right angles to the path of the device, precut grooves of appropriate size and depth can be formed in the fiberglass batting before loading the device 10. A lighted mirror, measuring tape, and the like will assist in determining the exact location of these obstructions. The device 10 can be maneuvered around most right angle obstructions by passing in front or in back of them. This is accomplished by gripping the handles of the device firmly when an obstruction is encountered. Pulling on the control sheet while pushing on the compressor sheet will cause the gripping tip of the compressor sleeve to swing against the inner wall. Maintaining the guiding edge against the inner wall the device can be pushed forward to bypass the front of the obstruction. Pulling the compressor sheet and pushing the control sheet will have the opposite effect, thus allowing the device 10 to bypass the obstruction by going behind it.

The foregoing description is provided for purposes of illustrating the present invention but is not considered to be limitative thereof. Clearly, numerous additions, deletions, and other modifications can be made by one of ordinary skill in the art without departing from the scope of the invention as set forth in the appended claims.

What is claimed is:

1. A device for installing batts of insulation in preexisting structures, comprising:

a control sheet having a substantially flat elongated surface for receiving a bat of insulation, a first end having a handle, and a second end which is free for insertion into a wall opening;

a compressor sheet having a substantially flat elongated surface for overlying said control sheet flat surface to compress a batt of insulation therebetween; a first end having a handle, and having a second end which is free for insertion into a wall opening;

means for connecting said control sheet second end to said compression sheet second end such that said sheets are maintained a predetermined distance apart to compress a batt of insulation and said compressor sheet second end and said control sheet second end overlie one another; and means for releasing said connecting means to release a batt of insulation after insertion into a wall opening.

2. The device as set forth in claim 1, wherein said compressor sheet second end includes a bent portion, and said control sheet second end includes a bent portion, wherein said bent portions overlie one another and extend in the same direction when said second ends are connected.

3. The device as set forth in claim 2, wherein said bent portion of said control sheet has a recurved portion forming a slot to receive a free end of said compression sheet bent portion.

4. The device as set forth in claim 1, wherein said connecting means is positioned at said second ends of said sheet, and said release means is positioned at said first ends of said sheets and further including a remote actuation connected to said connecting means.

5. The device as set forth in claim 1, further including gripping means disposed on said compressor sheet for gripping a batt of insulation.

6. The device as set forth in claim 5, wherein said gripping means comprises a plurality of teeth attached to said compressor sheet flat elongated surface.

7. The device as set forth in claim 6, wherein said teeth are angled toward said second end of said compressor sheet whereby said teeth grip a batt of insulation only when said compressor sheet is moved in the direction of said compressor sheet second end but release said batt of insulation when said compressor sheet is moved in the direction of said compressor sheet first end.

8. The device as set forth in claim 4, wherein said remote actuator comprises a cable, said connecting means comprises an eyelet connected to one of said sheets, an opening formed in the other of said sheets for receiving said eyelet, and a latching member connected to said cable and positioned for insertion into said eyelet when said eyelet has passed through said opening, and said release means comprises a control member connected to said cable for moving said cable, whereby movement of said control member causes said latching member to move into and out of said eyelet.

9. The device as set forth in claim 1, and further including means for attaching said control sheet first end to said compression sheet first end.

10. The device as set forth in claim 9, wherein said attaching means comprises a pair of offset flanges attached to opposite sides of said sheets defining opposed slots for receiving the opposite edges of the other of said sheets.

11. A method of installing batts of insulation in a preexisting building structure, comprising:

compressing a bat of insulation between two relatively flat sheets of flexible material by attaching said sheets together on opposite sides of said insulation;

inserting the compressed insulation and two sheets of material into an opening in said structure formed at one end of the position in which the insulation is to be placed such that one end of each sheet extends out of said opening and one end of each sheet extends into said opening;

releasing said sheets from each other when said insulation is approximately in position; and withdrawing said sheets from said opening to leave said insulation in place in said wall.

12. The method as set forth in claim 11, wherein the step of compressing comprises attaching the ends of said sheets together which are to be inserted into said opening and the step of releasing said sheets comprises detaching said sheets by actuating a release mechanism from a position externally of said opening.

13. The method as set forth in claim 11, wherein said step of withdrawing comprises pulling one of said sheets from said opening by a small amount, then pulling the other of said sheets from said opening by a small amount; then pushing both said sheets back into said opening to move said insulation bat further into said space, then withdrawing said sheets completely from said opening one at a time.

14. The method as set forth in claim 13, wherein said one of said sheets has a plurality of teeth formed thereon for engagement with said batt of insulation, and the step of withdrawing said sheets completely comprises withdrawing said one sheet first, then withdrawing said other sheet.

15. The method as set forth in claim 11, wherein each of said sheets has a bent end, said bent ends overlying one another when said sheets are attached, and said step of inserting comprising inserting said bent ends into said opening such that said bent ends align with the direction in which said insulation is to be inserted.

* * * * *